US005415351A

United States Patent [19]

Otto et al.

[11] Patent Number: 5,415,351

[45] Date of Patent: May 16, 1995

[54] PNEUMATIC SPRAY GUN WITH IMPROVED BEARING FRAME

[75] Inventors: Thomas J. Otto, Gower; Joseph T. Otto, Edgerton, both of Mo.

[73] Assignee: Kraft Tool Company, Kansas City, Mo.

[21] Appl. No.: 300,658

[22] Filed: Sep. 6, 1994

[51] Int. Cl.[6] ..... B05B 7/30

[52] U.S. Cl. ..... 239/345; 239/346; 239/378; 239/379; 239/394

[58] Field of Search ..... 239/345, 346, 526, 376, 239/378, 379, 394; 222/630

[56] References Cited

U.S. PATENT DOCUMENTS

| | | | |
|---|---|---|---|
| 1,294,190 | 2/1919 | Stürcke | 239/345 |
| 2,305,269 | 12/1942 | Moreland | 239/345 |
| 3,236,459 | 2/1966 | McRitchie | 239/376 |
| 4,863,104 | 9/1989 | Masterson | 239/345 |
| 5,232,161 | 8/1993 | Clemmons | 239/526 |

FOREIGN PATENT DOCUMENTS

| | | | |
|---|---|---|---|
| 2336186 | 7/1977 | France | 239/346 |

*Primary Examiner*—Andres Kashnikow
*Assistant Examiner*—Christopher G. Trainor
*Attorney, Agent, or Firm*—Litman, McMahon & Brown

[57] ABSTRACT

A pneumatic spray gun is provided with an improved bearing frame. The spray gun includes a body assembly and an actuator assembly therein. The actuator assembly controls the flow of pressurized air into the body assembly and also controls discharge of material in an air stream therefrom. The actuator includes a bearing frame subassembly with a pair of bearing bosses which receive bearings which in turn slidably receive an air stem subassembly.

19 Claims, 2 Drawing Sheets

PNEUMATIC SPRAY GUN WITH IMPROVED BEARING FRAME

BACKGROUND OF THE INVENTION

1. Field of the Invention

The present invention relates generally to pneumatic spray guns for spraying bulk material, and in particular to an improved bearing frame for a spray gun for spraying texturizing material from a hopper.

2. Description of the Related Art

Various types of finish and coating materials are commonly applied by spraying them onto surfaces which are to be finished or coated. Compressed air is often used for propelling paint and other finish materials. For example, paint is often applied in this manner using a compressor connected to a spray gun, which is also connected to a paint source.

Another example of a spray-applied finish is texturizing material of the type which is commonly applied to finished surfaces such as walls and ceilings in drywall construction and is generally liquidous, e.g., particles or granules mixed with water or relatively thin paint, the granules being variable in coarseness, texture, color, etc. Pneumatic spray guns can also be used for applying dry materials.

Pneumatic spray guns designed for such purposes often include air inlet openings for connection to compressors, material inlet openings for connection to material hoppers, and discharge orifices. Such spray guns typically include valve mechanisms for controlling their operation by selectively admitting air passage therethrough and opening the discharge orifices thereof.

The Masterson U.S. Pat. No. 4,863,104 discloses a fairly typical pneumatic spray gun apparatus of the type designed for applying texturizing material to walls, ceilings, etc. from a hopper. The Masterson spray gun apparatus includes an air valve operated by a trigger. When the air valve is open, a stream of air passes through the spray gun apparatus and receives material from a hopper supply. The air/material mixture exits the spray gun via a discharge orifice as a jet which can be directed onto the surface of a wall, ceiling, etc.

The present applicant also produced a spray gun of this general type, which included an air stem for continuously conveying an air stream through the spray gun and which slid within a pair of bearings. For proper operation, the bearings had to be aligned. Bearing misalignment could be caused by improper assembly, improper fit of the bearings within the body, and by external forces, such as the weight of the air hose tending to twist the rear/upstream bearing. Even a slight misalignment of the bearings in the applicant's prior art spray gun could cause the air stem to bind and drag, thus interfering with its effective operation and increasing wear on the bearings and the air stem, which slide relative to each other.

Moreover, the necessity of precisely aligning the bearings in applicant's previous spray guns required relatively tight tolerances in manufacturing and considerable care in assembly. With the bearing frame subassembly of the present invention, Applicant has found that greater precision can be achieved in aligning the bearings than with its previous design wherein the bearings were physically clamped in their operating positions by the assembled spray gun body.

The present invention relates to an improved bearing frame for such spray guns which tends to simplify their assembly, cleaning and maintenance and which tends to improve their operation.

Heretofore there has not been available a spray gun with an improved bearing frame with the advantages and features of the present invention.

SUMMARY OF THE INVENTION

In the practice of the present invention, a spray gun is provided which includes an improved bearing frame. The spray gun generally comprises a body assembly with an actuator chamber, a material feed chamber and a handle. The spray gun also includes an actuator assembly having an air stem subassembly, a trigger subassembly connected to the air stem subassembly and a bearing frame subassembly for mounting the actuator assembly in the body assembly. The bearing frame subassembly includes an upstream or rear bearing and a downstream or front bearing which are fixedly interconnected by a bridge portion for maintaining them in constant alignment. The air stem subassembly is longitudinally slidable within the bearings.

OBJECTS AND ADVANTAGES OF THE INVENTION

The objects and advantages of the present invention include: providing a spray gun which is adapted for spraying material fed from a hopper; providing such a spray gun with a valve mechanism adapted for controlling air flow and material feed; providing such a spray gun with an improved, one-piece bearing frame subassembly; providing such a spray gun wherein the bearing frame subassembly maintains bearings thereof in constant alignment; providing such a spray gun which includes a bearing frame subassembly adapted for retrofitting in existing spray guns or original installation in new spray guns; providing such a spray gun which is relatively easy to assemble; providing such a spray gun which provides relatively smooth air stem operation; providing such a spray gun which is efficient in operation, economical to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
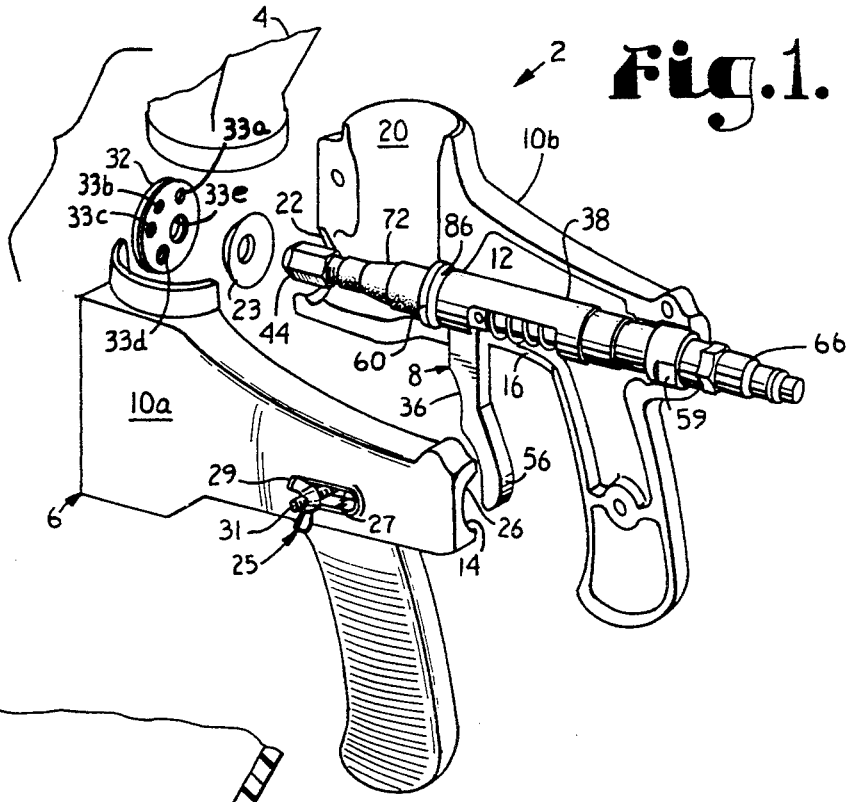
FIG. 1 is an exploded perspective view of a spray gun with an improved bearing frame embodying the present invention.
Figure 2:
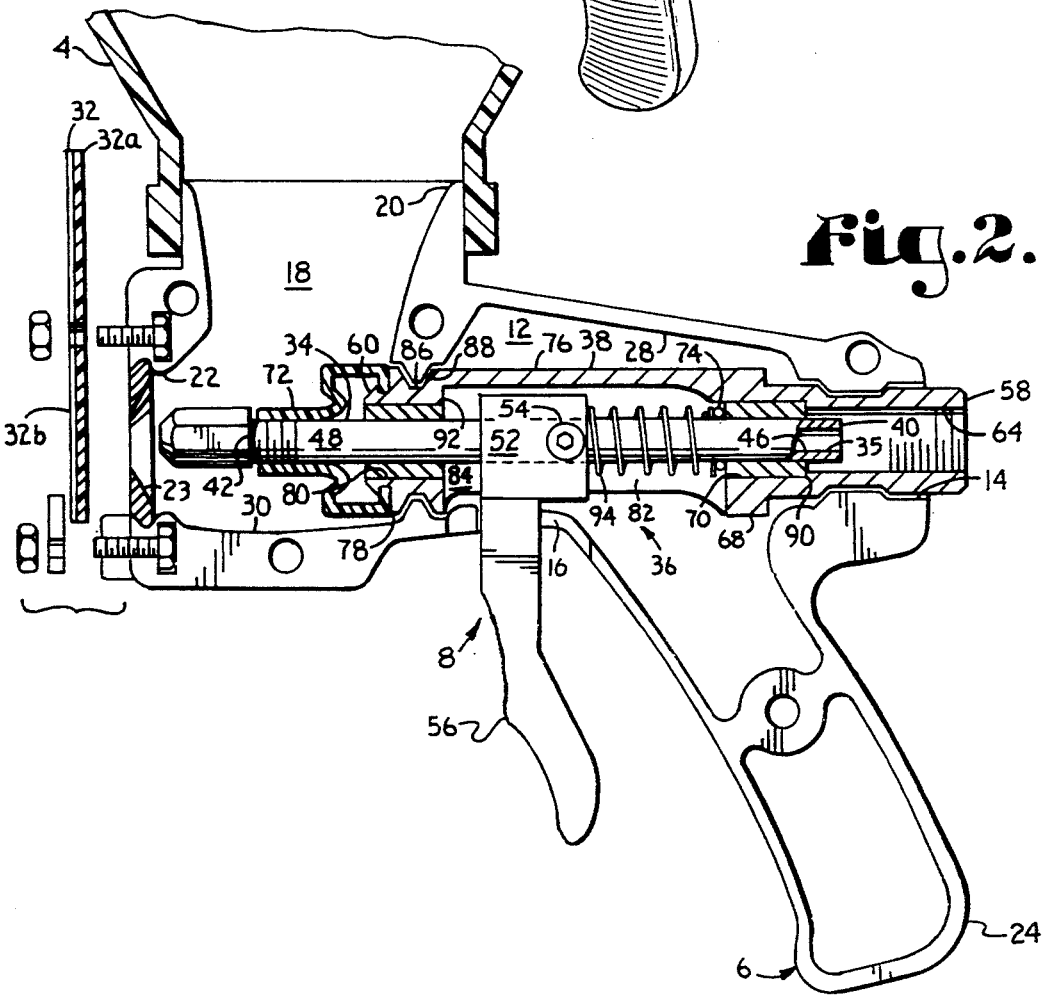
FIG. 2 is a longitudinal cross-sectional view thereof, showing the actuator assembly in an open position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally indicates a pneumatic spray gun. The spray gun 2 is adapted for receiving pressurized air from a pressurized air source (not shown) and propelling therewith a spray material which is dispensed from a hopper 4.

The spray gun 2 can comprise the type which is presently available from the applicant, Kraft Tool Co. of Kansas City, Miss., with the bearing frame improvements described herein. The spray gun 2 generally comprises a body assembly 6 and an actuator assembly 8.

II. Body Assembly 6

The body assembly 6 includes a pair of body halves 10*a*, 10*b* which can be cast or molded from a suitable material, such as metal or plastic. With the body halves 10*a*, 10*b* attached, the body assembly 6 forms: an actuator chamber 12 with an air inlet opening 14 and a downwardly-open trigger lever slot 16; a spray material chamber 18 with a material inlet opening 20 mounting the hopper 4 and a discharge opening 22 receiving a discharge cone 23; and a handle 24. The air inlet opening 14 includes a flat 26 and forms an upstream bore portion 28 for receiving the actuator assembly 8. The body half 10*b* forms a flat 26 on one side of the upstream bore portion 28 for resisting rotation of the actuator assembly 8. The body assembly 6 also forms a downstream bore portion 30 for receiving the actuator assembly 8.

A discharge control plate 32 includes a rubber washer 32*a*, a metal cover 32*b* and a plurality (e.g., five are shown) of discharge orifices 33*a*–33*e* which can be selectively aligned with the discharge opening 22 by rotating the discharge control plate 32. By selecting a discharge orifice 33*a*–*e* with the appropriate diameter, the spray pattern emitted by the spray gun 2 can be adjusted.

An adjustable stop mechanism 25 is mounted on the body half 10*a* and comprises a slot 27 formed in the body half 10*a* and communicating with the actuator chamber 12 and a wing nut 29 threadably mounted on a stop bolt 31, the latter being slidably adjustably received in the slot 27.

III. Actuator Assembly 8

The actuator assembly 8 generally includes an air stem subassembly 34, a trigger subassembly 36 and a bearing frame subassembly 38.

The air stem subassembly 34 includes an open upstream end 40 and a downstream end 42, the latter threadably mounting a nozzle 44. The air stem upstream end 40 includes an air inlet orifice 35 to permit the entry of air thereinto. The air stem subassembly 34 further includes a tubular barrel 48 with a generally coaxial air passage or bore 46 extending generally between the upstream and downstream ends 40, 42.

The trigger subassembly 36 includes a collar 52 adapted for fixed connection to the air stem subassembly 34 by means of a set screw 54. A trigger lever 56 depends downwardly from the collar 52 and slidably extends through the body trigger lever slot 16. The trigger lever 56, as shown, is angled rearwardly (i.e., in an upstream direction with respect to airflow) to provide a relatively comfortable grip for an operator when holding the actuator assembly 8 in an open position.

The bearing frame subassembly 38 includes upstream and downstream ends 58, 60 with a bearing frame passage 62 extending generally coaxially therebetween. A female-threaded air inlet port 64 is provided at the upstream end 58 and threadably receives an air fitting 66 which can be attached to a compressed air source (not shown), such as a compressor. The bearing frame subassembly upstream end 58 includes a pair of wrench flats 59. An upstream bearing boss 68 forms an upstream bearing receiver 70. An anti-rotation flat 61 is formed on one side of the upstream bearing boss 68 for engagement with the body half 10*b* flat 26. A bearing frame bridge portion 76 extends from the upstream bearing boss 68 to a downstream bearing boss 78 forming a downstream bearing receiver 80.

The bridge portion 76 forms a channel 82 which slidably receives the trigger subassembly collar 52 and terminates at a downstream channel slot 84 which slidably receives the trigger lever 56. The downstream bearing boss 78 includes an annular groove 86 for receiving a corresponding ring 88 formed by the body halves 10*a*, 10*b*.

Figure 3:
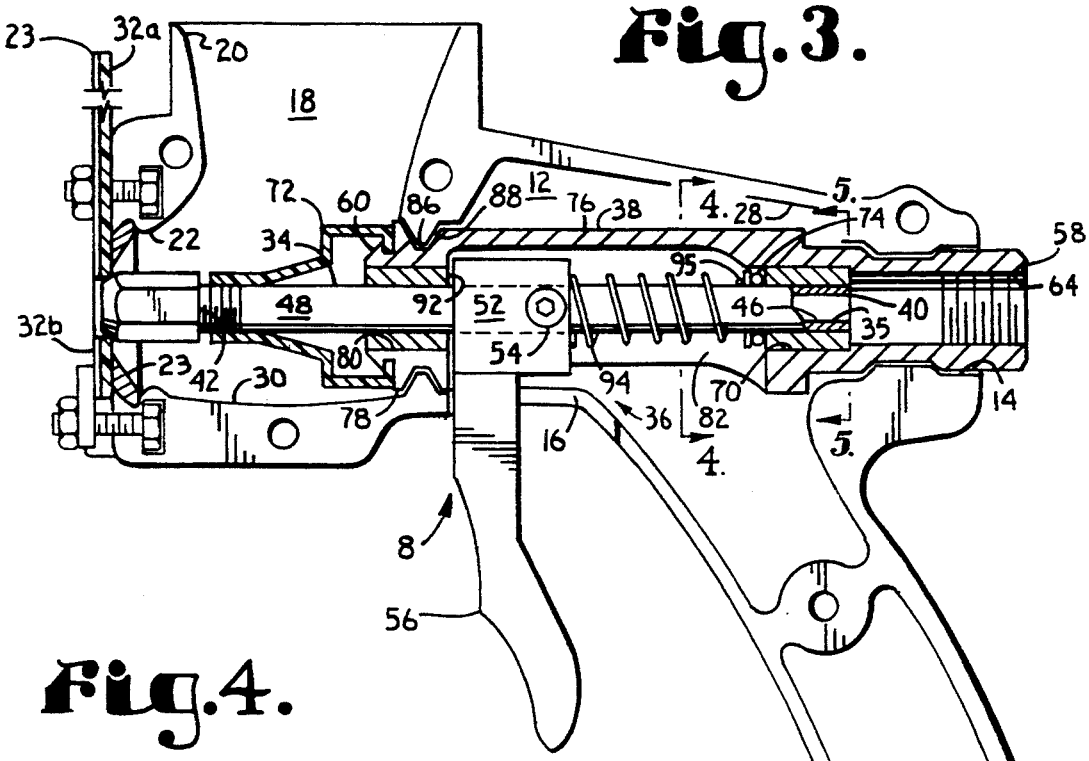
FIG. 3 is a longitudinal cross-sectional view thereof, showing the actuator assembly in a closed position.
Figure 4:
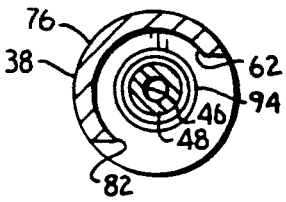
FIG. 4 is a transverse cross-sectional view thereof taken generally along line 4—4 in FIG. 3.

The upstream and downstream bearing bosses 68, 78 receive annular upstream and downstream bearings or bushings 90, 92 respectively. A seal which can comprise an O-ring 74 slidably receives the air stem barrel 48 at the front or downstream end of the rear or upstream bearing 90 to control air leakage through the rear or upstream bearing 90 around the air stem barrel 48. Alternatively, by providing relatively tight tolerances between the rear or upstream bearing 90 and the air stem barrel 48, the O-ring 74 can be eliminated. By maintaining the alignment of the bearings 90, 92, the bearing frame subassembly 38 enables the air stem barrel 48 and the bearings 90, 92 to be manufactured with relatively close tolerances therebetween, and further enables the air stem barrel 48 to slide relatively freely through the bearings 90, 92. A return spring 94 receives the air stem barrel 48 and engages the rear or upstream end of the collar 52. The air stem barrel 48 also receives a washer 95 which is positioned between the return spring 94 and the O-ring 74. The return spring 94 biases the actuator assembly 8, and more particularly the air stem subassembly 34, towards their closed positions with the nozzle 44 sealingly engaging a respective discharge orifice 33*a–e* (FIG. 3).

Figure 5:
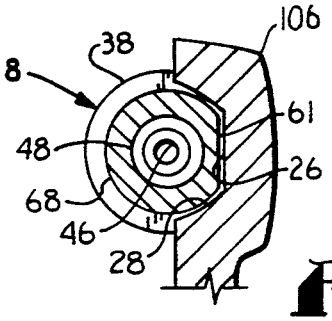
FIG. 5 is a transverse cross-sectional view thereof, taken generally along line 5—5 in FIG. 3.
Figure 6:
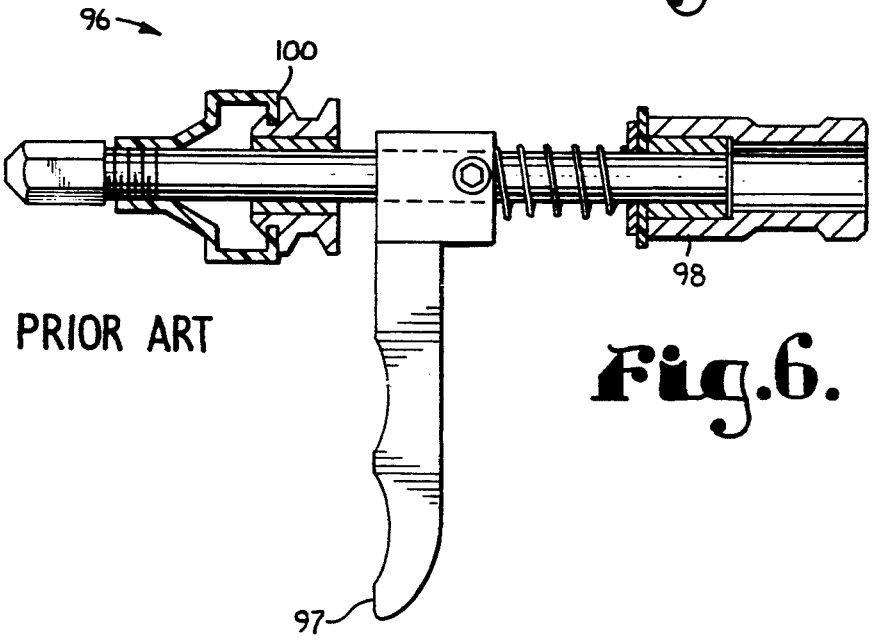
PRIOR ART Fig.6.
FIG. 6 is a fragmentary, longitudinal cross-sectional view of a prior art spray gun with separate bearing bosses.

A prior art spray gun is partially shown in FIG. 5 and is designated by the reference numeral 96. The prior art spray gun 96 (FIG. 3) has separate upstream/rear and downstream/front bearing bosses 98, 100 which are clamped in a position by the assembled body halves and a trigger lever 97 which differs in configuration from the new trigger lever 56.

IV. Operation

The improved bearing frame subassembly 38 is adapted for either installation in new spray guns 2 or retrofitting in previous spray guns 96.

The bearing frame subassembly 38 maintains proper alignment between the bearings 90, 92 whereby drag and binding are minimized as the air stem subassembly 34 reciprocates between its open and closed positions. Moreover, with the body halves 10*a*, 10*b* separated, the bearing frame subassembly 38 actuator assembly 8 with the aligned bearings 90, 92 is generally easier to install than the previous actuator assembly with separate bearing bosses 98, 100 of the prior art, which required proper placement and alignment to ensure free movement of the air stem subassembly 34.

The provision of a one-piece bearing frame subassembly 38 facilitates relatively fluid-tight engagement between the air stem barrel 48 and the bearings or bushings 90, 92. Thus, by providing sufficiently tight tolerances therebetween, the O-ring seal 74 can be eliminated.

The single-piece bearing frame subassembly 38 also functions to minimize binding and drag on the stem barrel 48, which can be exerted by a downward, twisting force on the upstream bearing or bushing 90 and which can be caused by the weight of an air hose attached to the air fitting 66. With the prior art bearing configuration as shown in FIG. 5, such a twisting force from the air hose and air fitting were concentrated on the upstream or rear bearing boss 98, which could tend to bind and create drag on the stem barrel 48. The one-piece bearing frame subassembly 38 can reduce such binding and drag problems which were previously associated with the upstream or rear bearing 90.

Rebuilding and reconditioning spray guns is also facilitated by using the single-piece bearing frame subassembly 38, since it can easily be placed in a disassembled body assembly 6 and is essentially self-aligning with respect to the air stem subassembly 34 and the body assembly 6.

The body half 10*b* flat 26 cooperates with the corresponding bearing boss flat 61 to resist rotation of the actuator assembly 8. The wrench flats 59 are adapted to receive a wrench for immobilizing the actuator assembly 8, e.g., when an air fitting 66 is screwed thereinto.

Slidably repositioning the adjustable stop mechanism 25 adjusts the rearmost (upstream) stop location of the actuator assembly 8, thereby controlling the volume of material flow through the discharge orifices 33*a–e* when the actuator assembly 8 is in its fully open position.

Without limitation on the generality of useful materials, the spray gun 2 can be provided with a chrome-plated stem barrel 48 and brass or bronze bearings 90, 92. The spray gun 2 can be provided with an adjustable stop mechanism (not shown) to adjustably control the travel of the actuator assembly 8 and the location of its fully-open position. Such stop mechanisms have been provided on the applicant's previous spray guns.

It is to be understood that while certain forms of the present invention have been illustrated and described herein, it is not to be limited to the specific forms or arrangement of parts described and shown.

What is claimed and desired to be secured by Letters Patent is as follows:

1. A pneumatic spray gun, which comprises:

(a) a body assembly including an air inlet opening, a material inlet opening, a discharge orifice and a handle;

(b) an actuator assembly including:

(1) an air stem subassembly with upstream and downstream ends and an air passage extending therebetween, said air stem subassembly having open and closed positions with respect to said discharge orifice;

(2) a trigger subassembly mounted on said air stem subassembly intermediate the upstream and downstream ends thereof and projecting from said body assembly; and (3) a bearing frame subassembly including upstream and downstream bearing means slidably receiving said air stem subassembly, an upstream end associated with said housing air inlet opening and including an inlet port communicating with said air stem subassembly passage, a downstream end and a bridge extending between said upstream and downstream bearing means; and (4) said trigger subassembly being generally positioned between said upstream and downstream bearing means.

2. The invention of claim 1, which includes:

(a) said upstream and downstream bearing means each comprising a bearing receiver and a bearing mounted therein.

3. The invention of claim 2 wherein said bearings comprise brass.

4. The invention of claim 3 wherein said air stem subassembly is chrome-plated.

5. The invention of claim 1 wherein:

(a) said actuator assembly includes a helical return spring receiving said air stem subassembly and engaging said upstream bearing means and said trigger subassembly, said return spring being compressed with said air stem subassembly in its open position and expanded with said air stem subassembly in its closed position.

6. The invention of claim 1, which includes:

(a) an elastomeric O-ring receiving said air stem subassembly and engaging said upstream bearing means.

7. The invention of claim 1 wherein said bearing frame subassembly includes a passage slidably receiving said air stem subassembly and extending between said upstream and downstream ends of said bearing frame subassembly.

8. The invention of claim 7 wherein said bearing frame subassembly includes a downwardly-open channel positioned generally below said bridge and partly receiving said trigger subassembly.

9. The invention of claim 1, which includes:

(a) said bearing frame subassembly having a flat adjacent said upstream end thereof, said flat engaging said body assembly and resisting rotation therebetween.

10. In combination with a pneumatic spray gun having: a body assembly including la pair of body halves, said body assembly forming an actuator chamber with an air inlet opening, a spray material chamber with a material inlet opening and a material discharge opening, and a handle; and an actuator assembly including upstream and downstream bearings mounted within the body assembly actuator chamber, an air stem subassembly slidably received in the bearings and movable between open and closed positions, and a trigger subassembly mounted on the air stem subassembly and projecting from said body assembly, the improvement of a bearing frame subassembly, which comprises:

(a) an elongated, generally tubular configuration;
(b) an upstream end with an air inlet port;
(c) a downstream end with a downstream bearing receiver receiving said downstream bearing;
(d) a downwardly-open channel located between said bearing frame ends and slidably receiving said trigger subassembly;
(e) an upstream bearing receiver located at an upstream end of said channel and receiving said upstream bearing;
(f) a coaxial bore extending between said ends and including said air inlet port, said downstream bearing receiver, said channel and said upstream bearing receiver; and
(g) said bearing frame subassembly is positioned generally within said body assembly actuator chamber.

11. The invention according to claim 10 wherein:

(a) said actuator assembly includes a helical return spring receiving said air stem subassembly and engaging said upstream bearing and said trigger subassembly, said return spring being compressed with said air stem subassembly in its open position and expanded with said air stem subassembly in its closed position.

12. The invention of claim 11, which includes:

(a) an elastomeric O-ring receiving said air stem subassembly and positioned in engagement with said upstream bearing adjacent to said channel.

13. The invention of claim 12, which includes:

(a) a washer receiving said air stem subassembly and positioned between said return spring and said O-ring.

14. The invention of claim 10, which includes:

(a) said bearing frame having a flat adjacent said upstream end thereof, said flat engaging said body assembly and resisting rotation therebetween.

15. The invention of claim 10 wherein said bearings comprise brass and said air stem subassembly is chrome-plated.

16. The invention of claim 10 wherein said trigger subassembly includes a collar fixably mounted on said air stem subassembly and a trigger lever extending downwardly and rearwardly from said collar, and said bearing frame subassembly includes a slot located at an upstream end of said channel and receiving said trigger lever.

17. The invention of claim 10 wherein said air stem subassembly includes:

(a) a barrel with a coaxial air passage;
(b) an upstream end with said barrel air passage open thereat;
(c) a downstream end; and
(d) a nozzle mounted on said barrel at said downstream end, said nozzle selectively closing said discharge opening with said actuator assembly in its closed position and being spaced from said discharge opening with said actuator assembly in its open position.

18. The invention of claim 10, which includes:

(a) adjustable stop means for adjusting the location of an upstream stop location for the actuator assembly.

19. A pneumatic spray gun, which includes:

(a) a body assembly having:
  (1) a pair of body halves adapted for connection along a medial seam;
  (2) an actuator chamber with an air inlet opening and a trigger lever slot;
  (3) a spray material chamber having a material inlet opening adapted for mounting a hopper and a discharge opening;
  (4) a handle; and
  (5) said air inlet opening including a flat; and
(b) an actuator assembly including:
  (1) an air stem subassembly including upstream and downstream ends, a stem barrel with an air passage extending therethrough, and a nozzle mounted on the downstream end thereof;
  (2) a trigger subassembly including a collar receiving said stem barrel and fixedly connected thereto, and a trigger lever extending rearwardly and downwardly from said collar through said body assembly trigger lever slot; and
  (3) a bearing frame subassembly having an upstream end with a flat engaging the air inlet opening flat in anti-rotational relationship therewith, a downstream end, an inlet port at said upstream end, an upstream bearing boss located in proximity to said upstream end, an upstream bearing receiver located in said upstream bearing boss, a downstream bearing boss located in proximity to said bearing frame subassembly downstream end, a downstream bearing receiver located in said downstream bearing boss, a bridge portion extending between and fixedly interconnecting said upstream and downstream bearing bosses, said bridge portion forming a downwardly-open channel, an upstream bearing received in said upstream bearing receiver, a downstream bearing received in said downstream bearing receiver, and a return spring receiving said stem barrel and positioned between said upstream bearing and said collar; and
(c) said actuator assembly having a closed, forward position with said nozzle substantially closing said discharge opening and said return spring extended and an open rear position with said nozzle disengaged from said discharge opening and said return spring compressed.

* * * * *